US007919732B2

(12) United States Patent
Blank et al.

(10) Patent No.: US 7,919,732 B2
(45) Date of Patent: Apr. 5, 2011

(54) METHOD AND CIRCUIT FOR IGNITING A GAS FLOW

(75) Inventors: Jürgen Blank, Gernrode (DE); Barbara Happe, Gernrode (DE)

(73) Assignee: Mertik Maxitrol GmbH & Co., KG, Thale (DE)

( * ) Notice: Subject to any disclaimer, the term of this patent is extended or adjusted under 35 U.S.C. 154(b) by 1356 days.

(21) Appl. No.: 10/545,049

(22) PCT Filed: Feb. 12, 2004

(86) PCT No.: PCT/EP2004/001300

§ 371 (c)(1),
(2), (4) Date: Aug. 11, 2005

(87) PCT Pub. No.: WO2004/072555

PCT Pub. Date: Aug. 26, 2004

(65) Prior Publication Data

US 2006/0068348 A1 Mar. 30, 2006

(30) Foreign Application Priority Data

Feb. 13, 2003 (DE) ..... 103 95 928

(51) Int. Cl.
*H05B 1/02* (2006.01)
*B23K 10/00* (2006.01)

(52) U.S. Cl. ..... 219/507; 219/121.54; 219/121.57; 219/121.48

(58) Field of Classification Search ..... 219/507, 219/494, 121.48, 121.59, 121.54, 121.57, 219/501, 492

See application file for complete search history.

(56) References Cited

U.S. PATENT DOCUMENTS

| | | | | |
|---|---|---|---|---|
| 2,948,335 | A | 8/1960 | Hegwein | |
| 4,325,512 | A * | 4/1982 | Kenshol | 239/84 |
| 5,630,384 | A * | 5/1997 | Mottier et al. | 123/149 R |
| 5,722,823 | A | 3/1998 | Hodgkiss | |
| 6,222,719 | B1 * | 4/2001 | Kadah | 361/247 |
| 6,972,115 | B1 * | 12/2005 | Ballard | 422/186.04 |
| 2004/0060582 | A1 * | 4/2004 | Sasaki et al. | 134/61 |

FOREIGN PATENT DOCUMENTS

| | | |
|---|---|---|
| CH | 325654 | 11/1957 |
| DE | 28 09 843 A1 | 9/1978 |
| DE | 31 26 639 A1 | 1/1983 |
| EP | 0 108 032 A2 | 5/1984 |

OTHER PUBLICATIONS

International Search Report of W02004072555 dated Jun. 24, 2004 (6 pages).
English translation of International Preliminary Report on Patentability of WO2004072555 dated Feb. 9, 2006 (4 pages).

* cited by examiner

*Primary Examiner* — Mark H Paschall
(74) *Attorney, Agent, or Firm* — Howard & Howard Attorneys PLLC

(57) ABSTRACT

The invention relates to a method and a circuit for igniting a gas flow in a fully automatic manner. The aim of the invention is to maintain the necessary current consumption so low that an integratable voltage source can be used. To this end, once an electronic control unit has been activated, a thermoelectric safety pilot valve (2) is opened by an electromagnet which is temporarily excited by a rush of current, is maintained in the open position by a safety pilot magnet (6) by means of a holding current provided by a voltage source (10), and the escaping gas is ignited. Once a thermoelectric couple (4) is provided for the necessary holding current, the voltage source (10) is switched off. In the event of damage, the method is automatically interrupted.

19 Claims, 3 Drawing Sheets

METHOD AND CIRCUIT FOR IGNITING A GAS FLOW

CROSS-REFERENCE TO RELATED APPLICATIONS

This application claims priority to and all advantages of PCT application No. PCT/EP2004/013000, filed on Feb. 12, 2004, which claims the priority and benefit of German patent application No. 103 95 928.8, filed on Feb. 13, 2003.

BACKGROUND OF THE INVENTION (1) Field of the Invention

The invention concerns a process for igniting a gas stream and a circuit arrangement for carrying out this process as can be used for a gas heating stove with gas regulator fittings.

(2) Description of Related Art

Facilities for a gas heating stove or the like are available in a large number of designs.

And so an ignition device for igniting gases is described in U.S. Pat. No. 5,722,823 A. The ignition device has a magnet coil that operates a gas valve, an igniter to ignite the gas stream electrically and a remote control that is connected to the magnet coil and the igniter via a low-voltage line. The remote control includes an energy supply and a time switch for timing the provision of low voltage.

This design requires a great deal of energy to ignite the gas stream. So there is provision for three relay coils, which means a relatively high power input. The solenoid valve is constantly energised during the ignition process, which results in a high power consumption. Consequently the only energy supply option is a mains supply. Another disadvantage is that faults occurring within the switch can lead to safety-related issues.

A valve device for controlling the ignition of a gas burner is familiar from the GB 2 351 341 A. An operating spindle is moved by hand into the ignition position, which opens the ignition locking valve. The operating spindle needs only be held a short time in this position as a microswitch is engaged when the operating spindle is moved. This causes a voltage to be made available from a power supply to engage the magnet. Ignition takes place by piezoelectric spark ignition. The power supply is switched off when the thermoelectric current provided by a thermocouple is sufficient to keep the ignition locking valve in its open position.

Even with this solution use of a power supply is a disadvantage. Additional effort is also needed to carry out the piezoelectric spark ignition. Especially where there is a fairly large conduction gap between the ignition locking valve and the burner aperture there is a further problem insofar as there cannot yet be any ignitable gas mixture at the burner aperture, as the time between the ignition locking valve opening and ignition is relatively short.

Further to this DE 93 07 895 U describes a multi-function valve with thermoelectric locking for gas burners on heating devices. This multifunction valve uses a room's existing power supply to operate it. To ignite the gas stream a magnetic valve is energised via a pushbutton, opening the ignition locking valve. The gas stream is ignited at the same time. A thermocouple in the area of the ignited gas flame is heated and puts a magnetic insert into an energised condition via the resultant thermoelectric current. The magnet holds an anchor firm and so keeps the ignition locking valve linked to the anchor in the open position. Now the pushbutton can be released and the magnetic valve be de-energised.

Here it is a disadvantage that the pressure valve must be held long enough until the thermoelectric current holds the ignition locking valve in the open position. It is also a disadvantage that the power consumption is relatively high in view of the fact that the magnetic valve must remain energised for this time via the power supply so that a mains supply is necessary.

Both solutions described in GB 2 351 341 A a in DE 93 07 895 U also have the disadvantage that they cannot be run fully automatically, and manual operation is necessary.

BRIEF SUMMARY OF THE INVENTION

The invention is based on the problem of developing a process for fully automatic ignition of a gas stream and a switch arrangement for carrying out this process that has such a low power consumption that it would be possible to employ an integrated electricity source with an adequate life. The structure should also be kept as simple and as inexpensive as possible.

According to the invention the procedural problem is solved by activating a transverter, which generates a higher voltage from direct current provided by an electricity source, with which a storage capacitor and an ignition capacitor to provide the ignition voltage are loaded. An essentially familiar ignition locking magnet is activated by a holding current provided by the electricity source, while at the same time an electric circuit that exists between the ignition locking magnet and a thermocouple that can be influenced by the gas flame is interrupted via a relay. The storage capacitor is now abruptly discharged via a circuit element, generating a current surge and briefly energising an electromagnet, to open an essentially familiar ignition locking valve and at the same time applying the anchor of the ignition locking magnet. Owing to the ignition locking magnet activated by the holding current the anchor is held in this position after application and a pilot light to ignite the outflowing gas is generated via an ignition electrode linked with the ignition capacitor via an ignition transformer in a familiar fashion. Subsequently further ignition procedures are initiated whereby the ignition capacitor is recharged and a new pilot light is generated after charging has taken place. After a prescribed period of time ignition is terminated. The holding current flowing from the electricity source to the ignition locking magnet is interrupted and the circuit between the ignition locking magnet and the thermocouple is closed via the relay.

This has found a solution, which remedies the aforementioned disadvantages of prior art. A brief operation of the electronic control unit facilitates ignition of the gas stream. In view of the only pulsed operation of the electromagnet, which is independent of how long the control unit is operated, there is a very low power requirement. It also possible to access the electricity source to generate the pilot light, so that there is no need for the additional cost of a piezoelectric ignition device.

Advantageous embodiments of the invention are, derived from the other patent claims.

It proves to be beneficial if, after the electronic control unit is activated to ignite the gas stream, a check takes place to determine whether a gas flame is alight. If the information is positive the ignition procedure is aborted, while if it is negative the aforementioned steps of the procedure are carried out.

There is also an advantageous embodiment of the process if the existence of a thermal electromagnetic force is measured, while other ignition procedures are initiated if there is an absence of thermal electromagnetic force. If however there is evidence of thermal electromagnetic force ignition is terminated. As soon as measurements of thermal electromagnetic force indicate that the electronically calculated thermoelectric current is sufficient to keep the anchor on the ignition locking magnet, the holding current flowing from the electricity source to the ignition locking magnet is interrupted and the electric circuit between the ignition locking magnet and the thermocouple is again closed via the relay.

It is also feasible for the storage capacitor and the ignition capacitor to be charged relatively easily via transverters assigned respectively to them at different voltages.

There is also a favourable embodiment of the process, if a higher alternating current is generated from the direct current supplied from the electricity source, whereby a power oscillator is used instead of the transverter and the storage capacitor is only switched to a first stage of a multiple cascade when the ignition procedure is initiated, whereupon the storage capacitor and the ignition capacitor connected by electrical conduction with the second stage of the multiple cascade are charged to prescribed higher voltages by means of the higher alternating current via the cascade circuit. After the prescribed higher direct current voltages have been reached the power oscillator is switched off and switched on again when other ignition procedures are initiated.

To reduce power requirements even further, which is particularly important when the electricity source is a battery, the dimensions of which can be so small that it can be located together with the electronic control unit in the housing of the receiver portion of a remote control, the holding current supplied by the electricity source to hold the anchor can flow simultaneously through the ignition locking magnet and the relay, while at the time that the electric circuit between the ignition locking magnet and the thermocouple is closed an additional current is briefly generated to safely prevent the anchor dropping out when the relay is rearranged because of the brief interruption in current when the switching contact of the relay is interposed. On the other hand it is also feasible for the voltage of the holding current supplied to the ignition locking magnet from the electricity source to be transverted to the millivolt range via an additional transverter.

It is also advantageous if the existence of a thermal electromagnetic force is measured using an analogue amplifier.

The safety of the process, such as when a breakdown occurs, is increased by a procedural step, which after a defined period of time has elapsed, also interrupts the energisation of the ignition locking magnet from the electricity source by using one or more independendent safety cutoffs, connected in series and timed.

To keep the time between the first ignition procedure and the following ignition procedures as brief as possible, it is desirable to save energy by disconnecting the storage capacitor from the cascade before further cyclical charges of the ignition capacitor.

As far as the circuit arrangement is concerned the problem is solved in accordance with the invention by the features stated in patent claim 12. Advantageous embodiments and evolutionary developments are set out in the associated subclaims.

BRIEF DESCRIPTION OF THE SEVERAL VIEWS OF THE DRAWINGS

The procedure that is the subject of the invention and circuit arrangement in accordance with the invention to ignite a gas stream is explained in further detail in an embodiment below. The individual representations show.

DETAILED DESCRIPTION OF THE INVENTION

Figure 1:
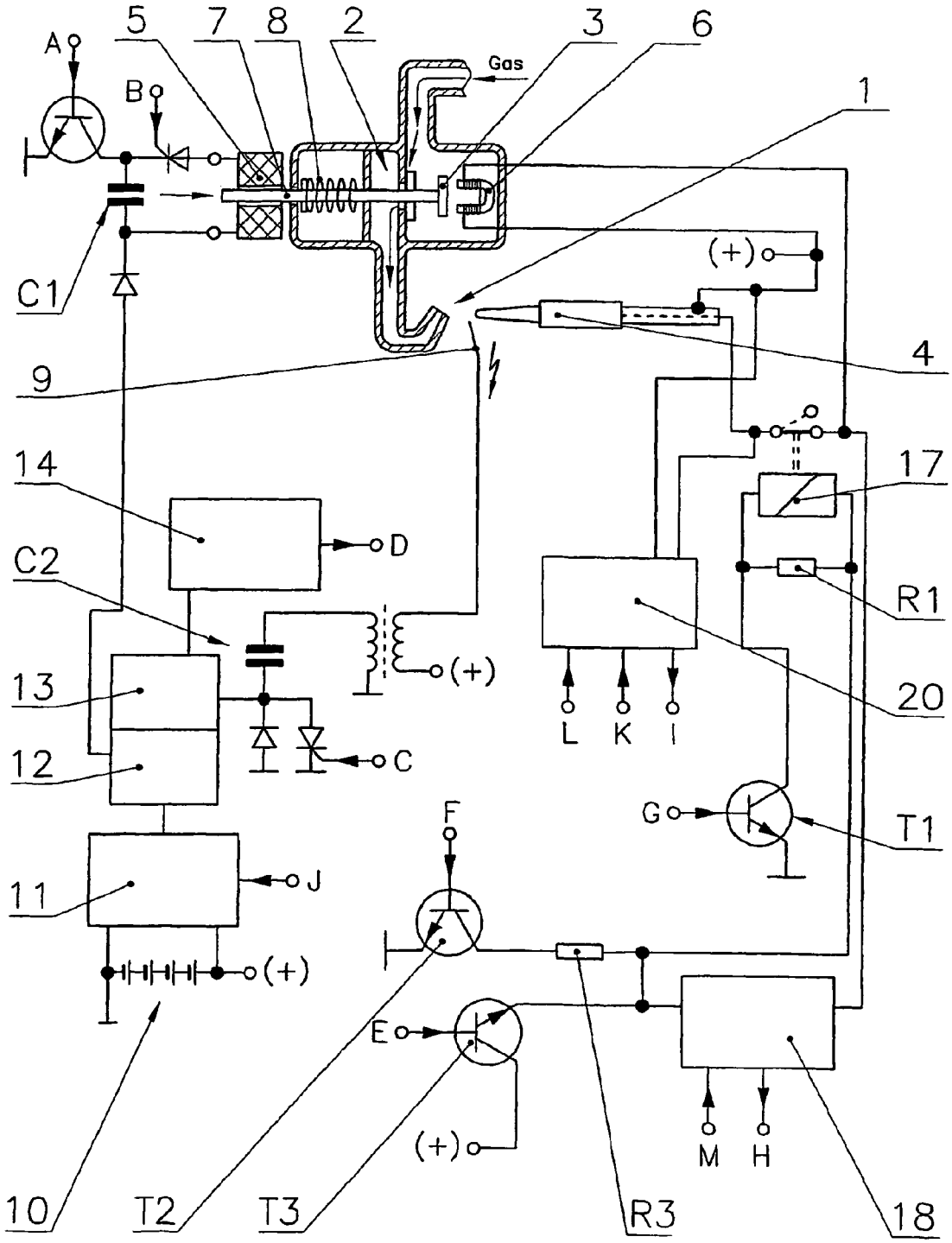
FIG. 1 a schematic representation of the circuit arrangement.

The circuit arrangement in accordance with the invention and exemplified in FIG. 1 to carry out the process of igniting a gas stream is employed on a gas regulating valve. This gas regulating valve is a switching and regulatory device that is preferably intended for installation in a gas-heated chimney stove or similar. It facilitates the operation and monitoring of a burner where the gas volume flowing to the burner is controlled. As well as assemblies that are not material to the invention and not therefore represented in this embodiment, the gas regulating valve also has an ignition burner 1 and a ignition locking valve 2. The design and function of the ignition burner 1 and the ignition locking valve 2 are familiar to specialists and have not therefore been explained in detail.

It is triggered by an undescribed microcomputer module serving as an electronic control unit, which in this embodiment is located in a likewise undescribed separately located housing of the receiver section of a remote control together with an electricity source 10. The electricity source 10 consists of standard commercial batteries as shown in the drawing, in this case size R6.

A power oscillator 11 detailed further below that can be triggered from the microcomputer module via a port J, is connected with the electricity source 10. In series with this is a cascade circuit 12/13 which serves to trigger and supply a downstream storage capacitor C1 and to trigger and supply a downstream ignition capacitor C2. As the voltage required to charge the storage capacitor C1 is significantly less than the voltage required to charge the ignition capacitor C2, the cascade circuit 12/13 is designed as a multiple cascade circuit.

Here the first stage of cascade 12 serves to trigger and supply the downstream storage capacitor C1. Downstream from this in turn is an electromagnet 5, which, as shown schematically in the drawing, serves to actuate an essentially familiar ignition locking valve 2. In view of the brevity of the charge a low thermal capacity so-called pulse magnet 5 is sufficient.

The second stage of the cascade 13 serves to trigger and supply the downstream ignition capacitor C2, which is part of an essentially familiar and therefore not further detailed ignition device. The ignition capacitor C2 can be triggered to ignite by the microcomputer module via port C. The second stage of cascade 13 is connected with an element 14 to monitor the voltage. At the same time element 14 serves to limit the maximum voltage that can occur, to prevent a destruction of components. An additional voltage monitor for the storage capacitor C1 can be omitted, as after the ignition capacitor C2 has been charged it can be assumed that the storage capacitor C1 has also been charged. Port D serves to send a check-back signal to the microcomputer module.

Figure 2:
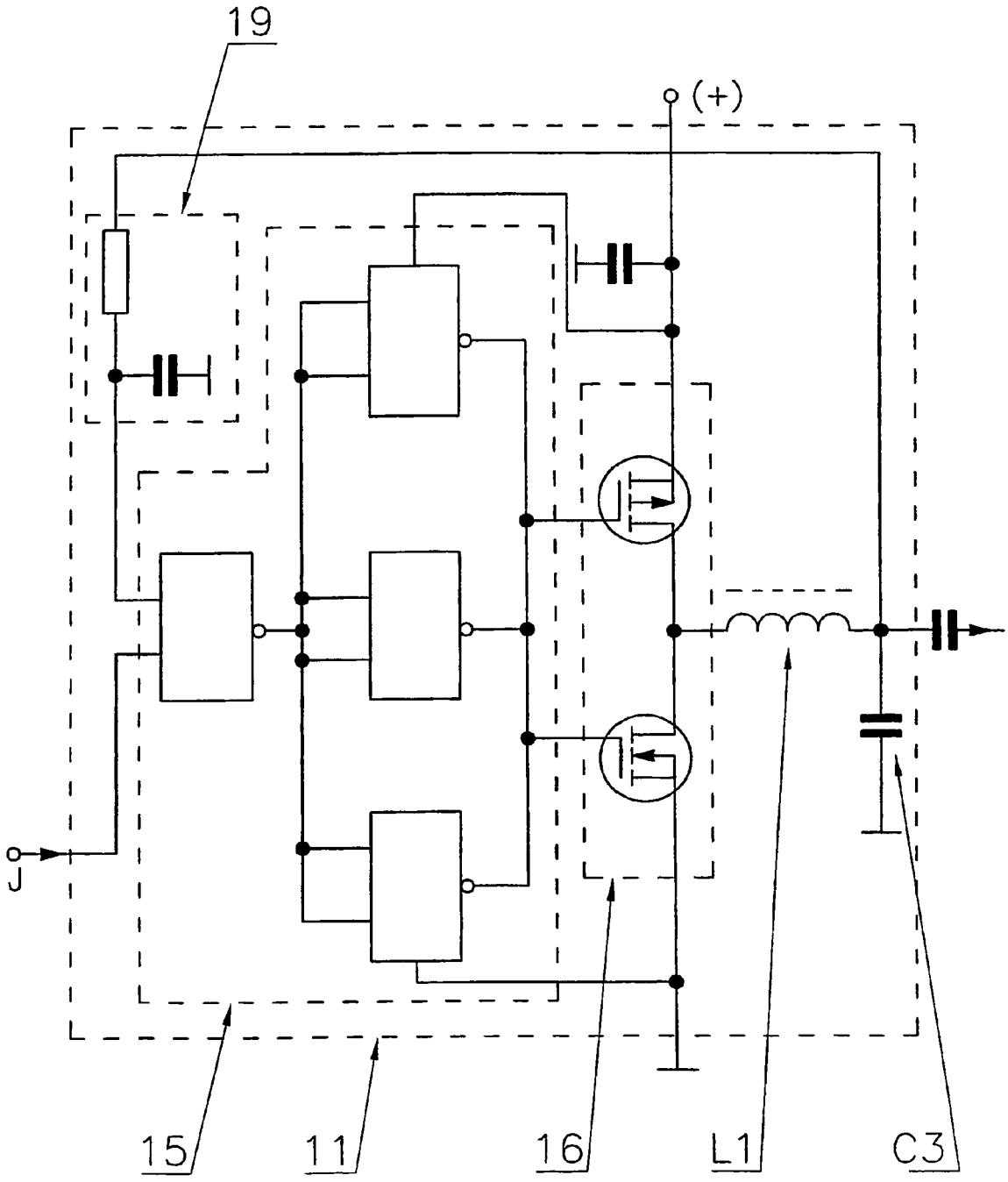
FIG. 2 a detailed representation of the power oscillator

FIG. 2 shows in detail the circuit for the power oscillator 11 being used. Power oscillator 11 consists of the CMOS electric circuit 15, essentially familiar to specialists, with at least four gates. These gates can be NOR gates, NAND gates, simple negators etc. Downstream from them is a complementary field effect power stage 16, to which an LC series oscillator circuit, consisting of coil L1 and HF condensor C3 is connected. An RC link serves as a so-called phase shifter 19 for feedback and phase adjustment.

As further indicated in FIG. 1, a ignition locking magnet 6 forming part of the ignition locking valve 2 is linked with a thermocouple 4. The normally closed contact of a monostable relay 17 is also located in this circuit, whereas this circuit is open in the energised state and the ignition locking magnet 6 receives current from the electricity source 10 supplied by the batteries. In addition to this a circuit element, in this case a transistor T1, which can be triggered by the microcomputer module via port G, is connected on the one hand with the electricity source 10 and on the other with the relay 17. A resistor RI is also located in parallel with relay 17, as the holding current required for the ignition locking magnet 6 is higher than the current flowing through the relay 17. This circuit also has two series-connected and timed safety cutoffs 18, which are connected for control purposes with the microcomputer module via the ports H and M.

Two further circuit elements, a transistor T2 and a transistor T3, are tied up to this circuit between relay 17 and safety cutoffs 18. While the transistor T2, upstream of which there is a resistor R3, is connected with the negative terminal of electricity source 10 and can be triggered by the microcomputer module via the port F, transistor T3 is connected with the positive terminal of electricity source 10 and can be triggered by the microcomputer module via the port E.

In addition to this an analogue amplifier 20 is connected in parallel with the thermocouple 4. This analogue amplifier 20 has the task of measuring a direct current at thermocouple 4 occurring in the millivolt range, amplifying it and converting it into a range that the microcomputer module can process. As the DC amplifiers otherwise customary for such instances on the one hand require an auxiliary supply above the operating voltage and on the other hand suffer drift deviations, due to temperature influences for example, the analogue amplifier 20 is designed as an AC amplifier.

Figure 3:
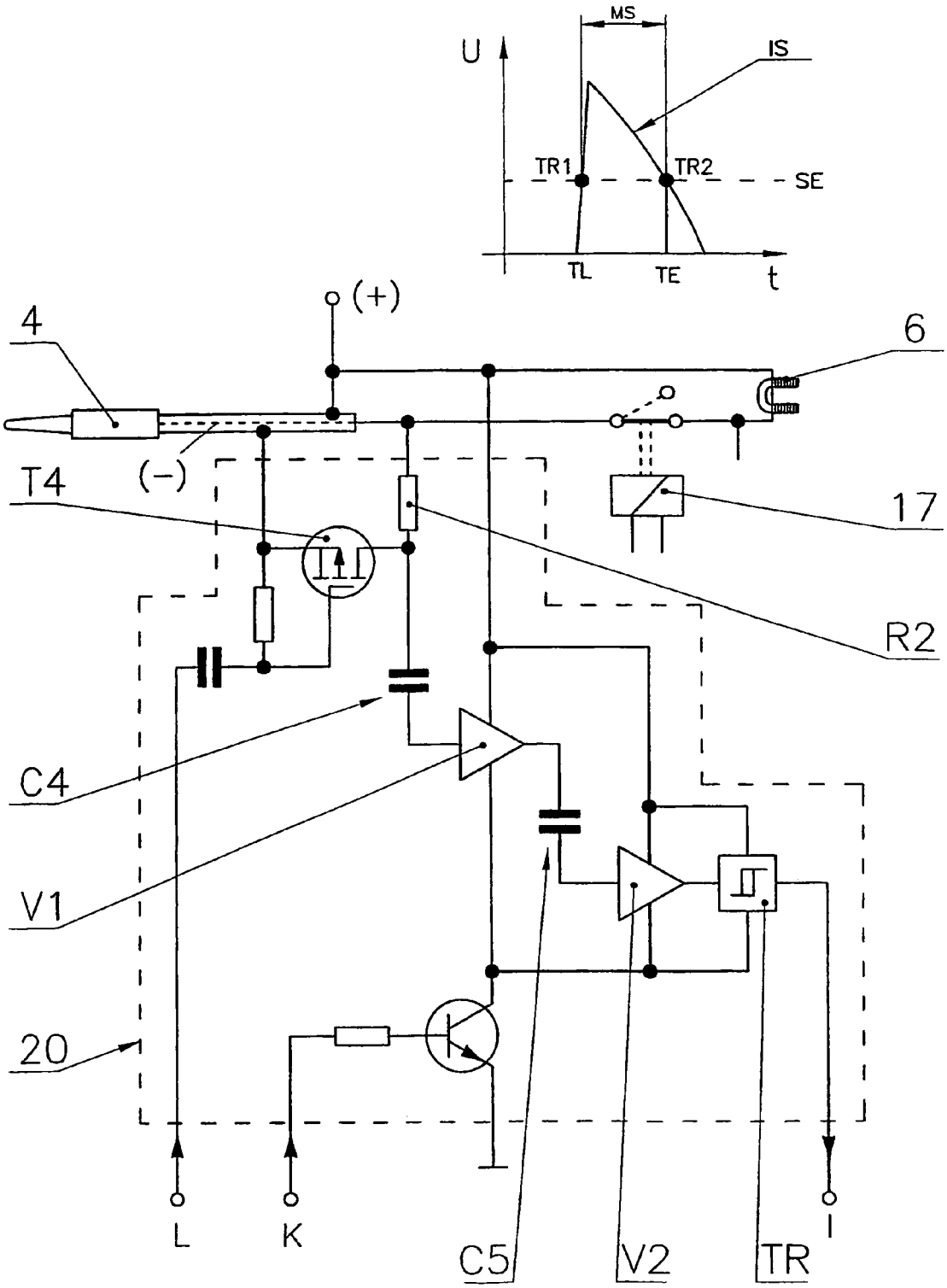
FIG. 3 a detailed representation of the analogue amplifier.

The analogue amplifier, as also described in FIG. 3, is described as follows:

A field effect transistor T4 that can be triggered by the microcomputer module via port L and a resistor R2 form a controllable voltage divider. A pre-amplifier and a booster amplifier are downstream from the voltage divider, with blocking capacitors C4/C5 assigned to each of them.

With the pre-amplifier V1 the reference potential is formed by the positive voltage in order to eliminate fluctuations in the on-board voltage. On the other hand, in the case of the booster amplifier V2 the reference potential is formed by mass. Both amplifiers V1/V2 and a trigger TR are operated by the microcomputer module through the port K, as they are rendered inoperable when not required to save electricity. The trigger TR behind the booster amplifier V2 is linked for its part with the microcomputer module via port I.

To carry out this process the ignition command is passed on to the microcomputer module via the remote control. The analogue amplifier 20 activated via port K checks whether a thermal electromagnetic force bears against thermocouple 4 and the relevant information is given to the microcomputer module via port I. Whereas the ignition procedure is aborted, if there is an existing thermal electromagnetic force, which is equivalent to a burning pilot light, if there is no thermal electromagnetic force the voltage divider of analogue amplifier 20 is triggered by the microcomputer module via port L. A single switching of the voltage divider will convert the direct current at thermocouple 4 at this time into a pulse of alternating current. The pulse reaches pre-amplifier V1 via the blocking capacitor C4. The signal from the preamplifier V1 is connected to the booster amplifier V2 via the blocking capacitor C5 and further amplified. This analogue signal coming from the booster amplifier V2 is digitalised by the trigger TR at fixed trigger points, as shown in the diagram associated with FIG. 3.

The diagram plots the course of voltage U during the time t. In a prescribed voltage level SE and on introduction of the pulse signal IS at time TL the trigger TR sets an initial trigger point TR1 and at the release of the voltage of pulse signal IS a second trigger point TR2, to which a time TE is assigned. The time lapse between the two points in time TL and TE is a measuring signal MS.

The measuring signal MS obtained from the existing thermal electromagnetic force reaches the microcomputer module via port 1. The length of measuring signal MS is directly proportional to the thermal electromagnetic force at thermocouple 4.

Whereas the ignition procedure is aborted if there is any thermal electromagnetic force, i.e. if the pilot light is already burning, if, on the other hand, there is no thermal electromagnetic force the power oscillator 11 will be activated by the microcomputer module via port J and the storage capacitor C1 will be switched to the first stage 12 of the multiple cascade via port A.

Activating the power oscillator 11 starts to oscillate the resonant circuit over the feedback element i.e. the resonant circuit becomes a self-oscillatory and frequency-determining power oscillator 11. This means that at the output from the power oscillator 11 there is a many times higher alternating current opposed to the low direct current supplied by the batteries at the input. This alternating current charges the storage capacitor C1 and the ignition capacitor C2 with the assistance of the two cascade stages 12/13, until element 14, which serves to monitor the voltage and limit the maximum voltage that occurs, responds and sends a signal via port D to the microcomputer module, which then switches off the power oscillator 11 via the port J.

Then the timed safety cutoffs 18 are activated via the port M and the ignition locking magnet 6 is supplied with a holding current from electricity source 10 via transistor T1 triggered via port G, energising relay 17, and so opening the circuit between ignition locking magnet 6 and thermocouple 4. The resonant circuit C1 is abruptly discharged by the subsequent triggering of port B. Thereupon resonant circuit C1 is separated from cascade stage 12 via port A. The pulse magnet 5 is briefly energised by this power surge and a tappet 7 is moved far enough against the force of a recoil spring 8 for the anchor 3 to attach to ignition locking magnet 6. Because of the flowing holding current the anchor 3 is held in this position and the ignition locking valve 2 in the open position. The gas can flow through the gas regulating valve to the ignition burner 1.

If a breakdown occurs as a result of a component failure or the like, after a defined period of time has elapsed the energisation of the ignition locking magnet 6 via electricity source 10 will also be interrupted by one or more independent safety cutoffs 18 connected in series and timed and the ignition locking valve will not remain in the open position, but will be closed again by recoil spring 8.

The microcomputer module activates the ignition device via port C, the ignition capacitor C2 discharges and the pilot light at ignition electrode 9 flashes over, igniting the outflowing gas.

After a prescribed period of time has elapsed, in this example approx. I second, the analogue amplifier 20 is activated via the ports K and L and a check is carried out to determine whether, because heating has commenced as a result of the burning pilot light, a detectable voltage is already being applied on thermocouple 4, i.e. at least approx. 1 mV.

If this is not the case, further ignition procedures will be introduced, while, as already explained in detail above, the power oscillator 11 will be activated, the ignition capacitor C2 will be charged and then discharged again when a new pilot light is generated. With these following ignition procedures the storage capacitor C1 is separated from cascade stage 12 to save power, as a further charging of the storage capacitor C1 is no longer necessary. Should no ignition of the gas occur within a specified period, the microcomputer module will abort the ignition procedure.

Should the minimum voltage exist no further ignition procedures will of course be initiated, but the available open circuit voltage of thermocouple 4 will again be checked until the amount of the current electronically calculated from this will be sufficient as holding current for ignition locking magnet 6. At this point the analogue amplifier 20 is deactivated via port K and the current flowing from the electricity source 10 to the ignition locking magnet 6 is interrupted via port G. The relay 17 is de-energised and the make-and-break contacts of relay 17 close the circuit between thermocouple 4 and ignition locking magnet 6. The anchor 3 is now held by the thermoelectric current.

To prevent anchor 3 dropping out because of the essentially brief interruption of the holding current when the make-and-break contacts of relay 17 are switched over, the transistor T2 is briefly activated via port F at the time of the switchover and an additional current is generated with similar brevity via the resistor R3, safely preventing the anchor dropping off as mentioned above.

Should the gas regulating valve be switched off the switch-off command is passed on to the microcomputer module via the remote control. By briefly activating port G and port E while circumventing the safety cutoffs 18 and the ignition locking magnet 6 a power surge is sent through relay 17, whose make-and-break contacts briefly lift off as a result. This interrupts the holding current flowing between thermocouple 4 and ignition locking magnet 6. The anchor is no longer held by the ignition locking magnet 6 and the ignition locking valve 2 closes under the influence of the recoil spring 8. The gas flow to ignition burner 1 and of course to the main burner—not shown—is interrupted and the gas flame is extinguished.

The process that is the subject of the invention and the circuit arrangement for carrying out this process are not of course limited to the embodiment described. Alterations, adaptations and combinations are possible without departing from the scope of the invention.

It is evident that the transmission of control signals can, as is generally known, be made by cable, infra-red, radio waves, ultra-sound etc. It is also possible for there no remote control to be used and for all the necessary components to be on or in the gas regulating valve. It is also possible for there to be just a main burner, which is ignited directly. Also a small plug-in power supply unit can be used as an electricity source (10) instead of batteries, which is then easy to plug in.

List of reference marks

| | | | |
|---|---|---|---|
| 1 | ignition burner | C2 | ignition capacitor |
| 2 | ignition locking valve | C3 | HF - capacitor |
| 3 | anchor | C4 | blocking capacitor |
| 4 | thermocouple | CS | blocking capacitor |
| 5 | pulse magnet | IS | pulse signal |
| 6 | ignition locking magnet | L1 | coil |
| 7 | tappet | LS | pulse signal |
| 8 | recoil spring | MS | measuring signal |
| 9 | ignition electrode | R1 | resistor |
| 10 | electricity source | R2 | resistor |
| 11 | power oscillator | R3 | resistor |
| 12 | cascade stage 1 | SE | voltage level |
| 13 | cascade stage 2 | TE | time at TR2 |
| 14 | Element for monitoring | TL | time at TR1 |
| | and limiting zung | TR | trigger |
| 15 | CMOS circuit | TR1 | trigger point |
| 16 | complementary - field effect | TR2 | trigger point |
| | power stage | T1 | transistor |
| 17 | relay | T2 | transistor |

-continued

List of reference marks

| | | | |
|---|---|---|---|
| 18 | safety cutoff | T3 | transistor |
| 19 | phase shifter | T4 | field effect transistor |
| 20 | analogue amplifier | V1 | pre-amplifier |
| A to M | ports | V2 | booster amplifier |
| C1 | storage capacitor | MS | measuring signal |

The invention claimed is:

1. Process for igniting a gas flow with an electronic control unit and a gas regulating valve, the gas regulating valve having an ignition burner (1) and an ignition burner valve (2), the ignition burner valve (2) operable between open and closed positions with an electromagnet (5) and held in the open position with a locking magnet (6), the process comprising the steps of:

generating a higher voltage from a direct current supplied from an electricity source (10), charging a storage capacitor (C1) and an ignition capacitor (C2) with the higher voltage to provide an ignition voltage (C2), activating the locking magnet (6) with a holding current provided by the electricity source (10), while at the same time interrupting an electric circuit between the locking magnet (6) and a thermocouple (4) that can be influenced by the gas flame via a relay (17).

discharging the storage capacitor (C1) via a circuit element to generate a surge of current which briefly energizes the electromagnet (5) to open the ignition burner valve (2) which is held open by the activated locking magnet (6), generating a pilot light at the ignition burner (1) by igniting gas flowing through the ignition burner valve (9) to the ignition burner (1) via an ignition electrode (9) electrically connected to the ignition capacitor (C2), and interrupting the holding current flowing from the electricity source (10) to the locking magnet (6) and closing the circuit between the ignition locking magnet (6) and the thermocouple via the relay (17) after a defined period of time has elapsed.

2. Process in accordance with claim 1, further comprising the steps of checking to determine whether a gas flame is alight and aborting any of the steps of the process if the gas flame is alight.

3. Process in accordance with claim 2, further comprising the steps of:

measuring the existence of thermal electromagnetic force, performing said step of initiating further ignition procedures in response to a lack of the thermal electromagnetic force, terminating the ignition in response to the existence of the thermal electromagnetic force, calculating a thermoelectric current from the thermal electromagnetic force, and interrupting the holding current flowing from the electricity source (10) to the locking magnet (6) and closing the circuit between the locking magnet (6) and the thermocouple via the relay (17) in response to the thermoelectric current being sufficient to hold open the ignition burner valve with the locking magnet (6).

4. Process in accordance with claim 3, wherein the storage capacitor (C1) and the ignition capacitor (C2) are charged via respective power converters.

5. Process in accordance with claim 3, wherein the higher voltage is generated using a power oscillator (11), the storage capacitor (C1) is electrically connected to a first stage (12) of a multiple cascade downstream of the power oscillator (11), and the ignition capacitor (C2) is electrically connected to a second stage (13) of the multiple cascade.

6. Process in accordance with claim 5, further comprising the step of switching off the power oscillator (11) in response to the capacitors (C1, C2) being charged to a prescribed DC voltage.

7. Process in accordance with claim 6, wherein the holding current supplied from electricity source (10) simultaneously flows through the locking magnet (6) and the relay (17), and that at the time that the electric circuit between the locking magnet (6) and the thermocouple (4) is closed by closing the relay (17), an additional current is briefly generated.

8. Process in accordance with claim 6, wherein the voltage of the holding current supplied to the locking magnet (6) from electricity source (10) is in the millivolt range.

9. Process in accordance with claim 8, wherein the existence of a thermal electromagnetic force is measured by an analogue amplifier (20).

10. Process in accordance with claim 9, wherein the step of interrupting the holding current provided to the locking magnet (6) is further defined has interrupting the holding current provided to the locking magnet (6) with one or more safety cutoffs (18) connected in series after a defined period of time has elapsed.

11. Process in accordance with claim 5 further comprising the step of disconnecting the storage capacitor (C1) from the multiple cascade (12) prior to charging the ignition capacitor (C2).

12. Circuit arrangement for igniting a gas flow with an electronic control unit and a gas regulating valve, the gas regulating valve having an ignition burner (1) and an ignition burner valve (2), the ignition burner valve (2) operable with an electromagnet (5) between an open position and a closed position and held in the open position with a locking magnet (6), the circuit arrangement comprising:

a power converter connected to an electricity source (10), a storage capacitor (C1) disposed downstream from the power converter and electrically connected to the electromagnet (5) to operate the ignition burner valve (2), an ignition capacitor (C2) electrically connected to an ignition electrode (9), a relay (17) electrically connecting the locking magnet (6) either to the electricity source (10) or a thermocouple (4), at least one timed safety cutoff (18) disposed between the electricity source (10) and the ignition locking magnet (6), and an element electrically connected to the electronic control unit for measuring the voltage of the thermocouple (4).

13. Circuit arrangement in accordance with claim 12, further comprising an element (14) electrically connected to the storage capacitor (C1) to monitor and limit the voltage of the storage capacitor (C1).

14. Circuit arrangement in accordance with claim 12, wherein the element (14) is also electrically connected to the ignition capacitor (C2) to monitor and limit the voltage of the ignition capacitor (C2).

15. Circuit arrangement in accordance with claim 14, wherein the power converter is further defined as a power oscillator (11) connected to the electricity source (10), and wherein a cascade (12/13) is downstream from the power oscillator (11), and the element (14) is located after the cascade (12/13) for monitoring and limiting voltage.

16. Circuit arrangement in accordance with claim 13, wherein the power oscillator (11) includes at least one CMOS circuit (15) a complementary field effect power stage (16) downstream from the at least one CMOS circuit, an LC resonant circuit (L1/C3) downstream from the at least one CMOS circuit, and a phase shifter (19).

17. Circuit arrangement in accordance with claim 16, wherein the element for measuring the voltage of the thermocouple (4) is further defined as an analog amplifier (20).

18. Circuit arrangement in accordance with claim 17, wherein the analog amplifier (20) is an AC amplifier disposed downstream from a clocked voltage divider.

19. Circuit arrangement in accordance with claim 16, wherein the at least one CMOS circuit (16) includes at least four gates with at least two of the gates electrically connected in parallel and at least one of the gates disposed upstream from the at least two of the gates electrically connected in parallel.

* * * * *

UNITED STATES PATENT AND TRADEMARK OFFICE

CERTIFICATE OF CORRECTION

PATENT NO. : 7,919,732 B2
APPLICATION NO. : 10/545049
DATED : April 5, 2011
INVENTOR(S) : Jürgen Blank and Barbara Happe It is certified that error appears in the above-identified patent and that said Letters Patent is hereby corrected as shown below:

Column 8, line 27, Claim 1, after "(17)", please delete "." and insert -- , --.

Signed and Sealed this
Twenty-eighth Day of June, 2011

David J. Kappos

David J. Kappos
*Director of the United States Patent and Trademark Office*